US006193169B1

(12) United States Patent
Steinhilber et al.

(10) Patent No.: US 6,193,169 B1
(45) Date of Patent: Feb. 27, 2001

(54) ROTATING SPRAY NOZZLE WITH CONTROLLED BRAKING ACTION

(75) Inventors: Ernst Steinhilber, Moglingen; Heinz Kutterer, Leutenbach, both of (DE)

(73) Assignee: Spraying Systems Deutschland GmbH (DE)

( * ) Notice: Subject to any disclaimer, the term of this patent is extended or adjusted under 35 U.S.C. 154(b) by 604 days.

(21) Appl. No.: 08/929,287

(22) Filed: Sep. 8, 1997

Related U.S. Application Data

(63) Continuation of application No. 08/667,492, filed on Jun. 24, 1996, now abandoned, which is a continuation-in-part of application No. 08/296,818, filed on Aug. 26, 1994, now abandoned.

(30) Foreign Application Priority Data

Aug. 26, 1993 (DE) ..... 43 28 744

(51) Int. Cl.[7] ..... B05B 3/04
(52) U.S. Cl. ..... 239/240
(58) Field of Search ..... 239/237, 240, 239/252

(56) References Cited

U.S. PATENT DOCUMENTS

| | | | | |
|---|---|---|---|---|
| 996,480 | * | 6/1911 | Glase | 239/240 |
| 2,509,076 | * | 5/1950 | Royer | 239/264 |
| 2,756,099 | * | 7/1956 | Reynolds | 234/240 |
| 3,623,667 | * | 11/1971 | Costa | 239/237 |
| 4,951,877 | | 8/1990 | Arsi . | |

FOREIGN PATENT DOCUMENTS

| | | | | |
|---|---|---|---|---|
| 680684 | * | 2/1969 | (CA) | 239/240 |
| 34 19 964 C2 | | 4/1986 | (DE) . | |
| 38 29 807 C1 | | 10/1989 | (DE) . | |
| 42 25 421 A1 | | 2/1993 | (DE) . | |
| 8150 | * | 5/1904 | (GB) | 239/240 |

* cited by examiner

*Primary Examiner*—Kevin Weldon
(74) *Attorney, Agent, or Firm*—Leydig, Voit & Mayer, Ltd.

(57) ABSTRACT

A spray nozzle head is rotated directly by a turbine which is driven by the pressure of liquid at the inlet of the nozzle. The turbine is supported by a thrust bearing which also acts as a friction brake to cause the rotational speed of the nozzle head to remain substantially constant as the inlet pressure increases through a predetermined range.

22 Claims, 3 Drawing Sheets

ROTATING SPRAY NOZZLE WITH CONTROLLED BRAKING ACTION

This is a continuation of Ser. No. 08/667,492 filed on Jun. 24, 1996 now abandoned, which is a continuation of 08/296,818, filed on Aug. 26,1994, now abandoned.

FIELD OF THE INVENTION

This invention relates to a rotating nozzle for spraying one or more jets of water or other fluid.

BACKGROUND OF THE INVENTION

In the cleaning of walls such as a container wall, it is necessary to use a liquid jet which impinges on the wall with a comparatively high jet force. All parts of the wall must be reached with the jet in order to achieve the desired cleaning effect. In the case of, for example, a cylindrical container, it is advantageous to use a rotating nozzle head which itself sprays the jet over the entire inner circumferential surface of the container. The cleaning fluid that flows through the nozzle is used to rotate the nozzle head.

To be effective, a rotating nozzle head must run slowly in order to insure thorough cleaning of the container wall rather than mere wetting of the wall. High speed nozzles produce a spray jet of fine particles which are retarded by ambient atmosphere and do not impinge on the container wall with sufficient velocity to ensure effective cleaning of the wall. Moreover, it is desirable that the nozzle head rotate at a speed that is substantially independent of the pressure of the cleaning fluid and especially when the cleaning fluid is foam. In order to provide a slowly rotating nozzle head, it is a known practice to use the cleaning fluid to drive a turbine which acts through a gear to rotate the nozzle head. The requirement for a gear makes the nozzle structure relatively expensive.

SUMMARY OF THE INVENTION

The general aim of the present invention is to provide a comparatively low cost rotating nozzle in which the nozzle head is driven directly and without a gear at a low rotational speed and in which the speed of the head in a predetermined pressure range remains relatively constant.

In part, the foregoing is achieved through the provision of a rotating nozzle having an axial thrust bearing with relatively slidable surfaces which act simultaneously as a friction brake, the braking action of which is controlled by the fluid pressure. Although it is not fully known as to how the friction brake automatically limits the rotational speed, it is possible that, at low pressures, a liquid friction exists in the axial gap of the two bearing surfaces of the axial bearing as a result of the liquid flowing through the nozzle. At increasing pressures, the friction is believed to convert into a dry friction by reason of increased pressure forces acting on upstream surfaces of the turbine that act to increase braking action of the axial bearing surfaces of the thrust bearing. Thus, the coefficient of friction changes in dependence on pressure and, up to an operating pressure of 0.5 bar, the rotational speed of the turbine and the nozzle head increases approximately proportionally to the pressure, there being achieved depending on construction of the nozzle a rotational speed up to about 35 r.p.m. At about 0.5 bar, the proportionality between rotational speed and fluid pressure ends. Above such pressure, the rotational speed actually begins to decline, the decrease in the rotational speed also being dependent on construction parameters of the nozzle.

In order not to impair the desired braking effect by the axial thrust bearing, no appreciable sealing is provided at the bearing except for the sealing effected by the bearing itself. Automatic starting of the rotating nozzle head may be achieved when the coefficient of friction in the axial thrust bearing is low and lies in the range between 0.05 and 0.15. Such coefficients of friction can be achieved if one or both axial bearing surfaces contain, for example, PTFE or a material with a comparable coefficient of friction.

In order to make the turbine efficient, an injector is located on the inlet side of the turbine. Inclined passages in the injector generate a generally tangential jet flow into the turbine. A very simple turbine is provided in the form of a cylindrical plate, in the outer circumferential surface of which grooves are formed to define passages. To enable the rotating nozzle head to start of itself and run with uniform angular velocity, the number of passages in the injector is aliquot of the number of passages in the turbine.

These and other objects and advantages of the invention will become more apparent from the following detailed description when taken in conjunction with the accompanying drawings.

Figure 1:
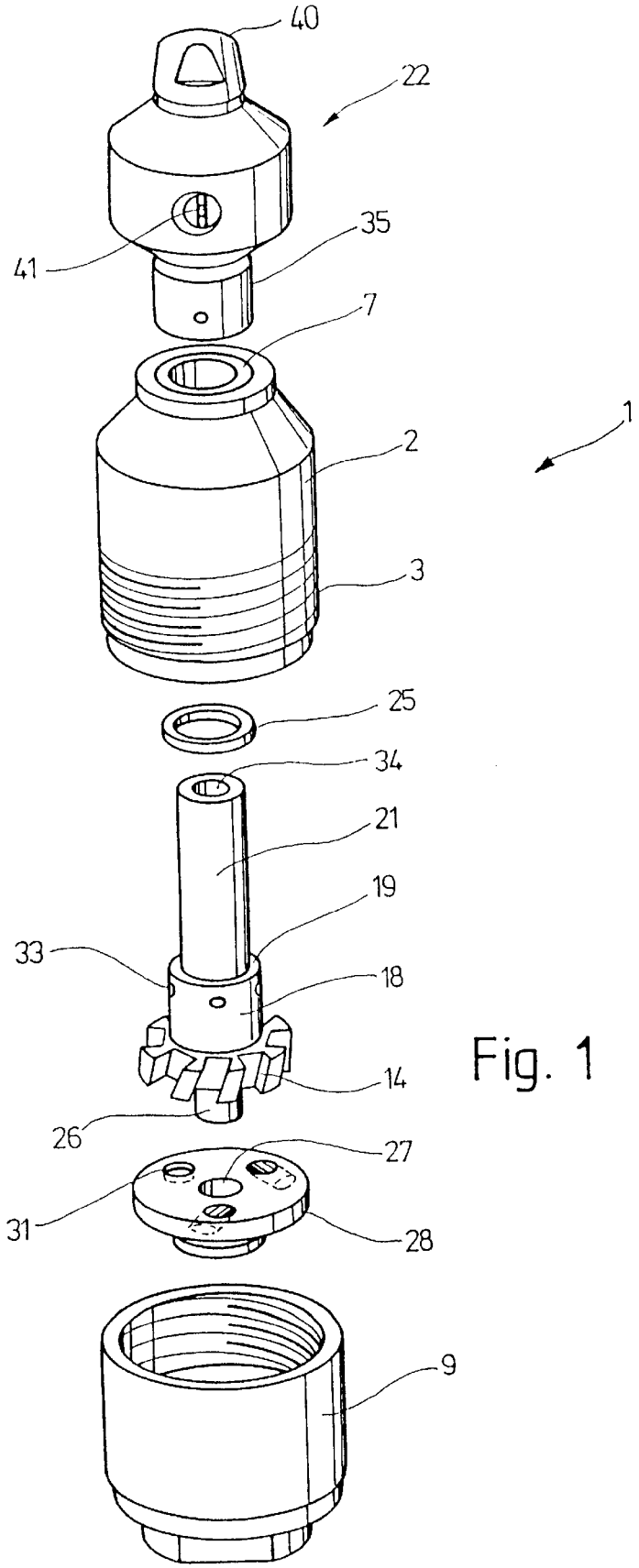
FIG. 1 is an exploded perspective view of a new and improved rotating nozzle incorporating the unique features of the invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Figure 2:
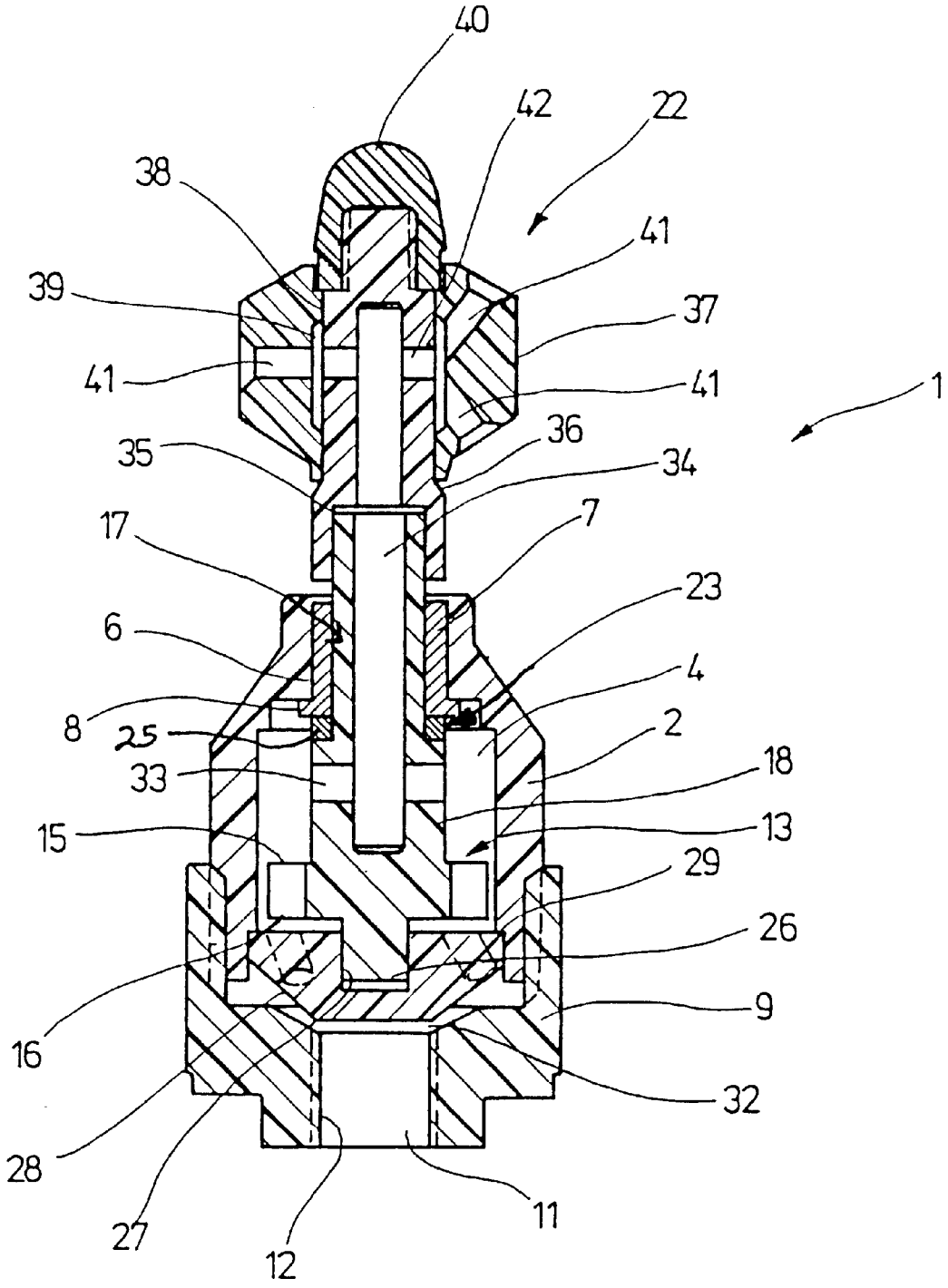
FIG. 2 is a cross-sectional view taken axially through the nozzle.

As shown in FIGS. 1 and 2, the rotating nozzle 1 of the invention has a generally cylindrical housing 2 which is provided on its lower end with an external thread 3. The housing 2 defines a continuously cylindrical chamber 4. A bore 6 is formed through the housing 2 coaxially with the chamber and extends between the chamber and the upper end of the housing. In the bore 6 there is inserted a bushing 7, the flange 8 of which is located in the chamber 4.

The lower end of the chamber 4 is closed by a cap nut 9 which is threaded onto the body 2 and which is formed with a fluid inlet 11. The fluid inlet is a bore with an internal thread 12 and is formed through the bottom of the cap nut 9.

In the cylindrical chamber 4, which has a constant cross section up to the vicinity of the flange 8, there rotates a turbine 13. The turbine 13 is a cylindrical plate whose outside diameter is slightly less than the diameter of the chamber 4. Formed in the outer circumference of the plate are several (e.g., eight) grooves 14 of rectangular cross-section. The grooves 14 pass through the plate from its upper face 15 to its lower face side 16 and open radially outwardly. Further, the grooves 14 are obliquely inclined with respect to the axis of rotation and the coincident axis of symmetry of the turbine 13. The angle which the long axis of each groove 14 makes with a projection of the axis of rotation of the turbine 13 lies between about 10 degrees and 40 degrees. In the example shown, the angle is 25 degrees.

Formed integrally with the upper side 15 of the plate forming the turbine 13 is a turbine shaft 17. The turbine shaft 17 has, directly adjacent the turbine 13, a relatively large diameter cylindrical section 18 which defines an annular shoulder 19 at its junction with a cylindrical section 21 of reduced diameter. The diameter of the section 21 is such that it can rotate with very little play in the bore of the bushing 7, that bore defining a cylindrical radial bearing surface for the shaft. The length of the section 21 is such that the turbine shaft 17 extends upwardly from the housing 2 in order to make it possible to fasten a nozzle head 22 on its upwardly projecting end.

The axial forces arising in the operation of the nozzle 1 are absorbed by an axial thrust bearing 23 which also forms a friction brake. One bearing surface of the thrust bearing is the axially and downwardly facing surface of the flange 8. A washer 25 is slid onto the turbine shaft 17 to the shoulder 19 and is sandwiched between the shoulder and the flange 8. In order to keep the dry friction in the axial bearing 23 as small as possible, both the bushing 7 and the washer 25 are made of PTFE or a comparable material. The washer 25 is of rectangular cross-section and its outside diameter is about 19 mm while its inside diameter is about 13 mm and corresponds with the outside diameter of the section 21 of the turbine shaft 17. The height of the washer 25 is about 1 mm. In addition to the bearing 6, on the lower face 16 of the turbine 13 there is molded a further bearing formed in part by a cylindrical stub shaft 26 which is coaxial with the turbine shaft 17. The stub shaft 26 rotates in a blind bore 27 which is formed in an insert body 28. The insert body 28 has the form of a flat truncated cone and is seated in the lower end of the housing 2 with its smaller end facing the cap nut 9. To prevent the insert body 28 from being pushed upwardly by the fluid pressure, its diameter is somewhat larger than that of the main section of the chamber 4 in the zone of the turbine 13, the chamber 4 being cylindrically enlarged near its lower end to define a radially inwardly extending shoulder for holding the insert body.

The insert body 28 is formed with three obliquely inclined and equally spaced bores 31 which lie on a partial-circle diameter equal to the partial-circle diameter of the grooves 14 of the turbine 13. The bores 31 are inclined in an opposite direction from and at a steeper angle than the grooves 14 and, in the example shown, the angle which the axis of each of the bores 31 makes with respect to the axis of rotation of the turbine 13 is about 55 degrees. Depending upon the angle of the grooves 14, however, the angle of the bores could range between 15 degrees and 75 degrees. The diameter of each bore 31 is about 4 mm and is somewhat smaller than the width of each groove 14 as measured in the circumferential direction. The insert body 28 thus acts as the injector for a turbine 13.

Fluid flows from the fluid inlet 11 to the passage bores 31 through a gap 32 between the insert body 28 and the bottom of the cap nut 9. From the chamber 4, the fluid flows through transverse bores 33 which are formed in the turbine shaft 17 in the larger diameter section 18 thereof. The transverse bores 33 communicate with a blind bore 34 which opens upwardly out of the upper end of the shaft.

The nozzle head 22 comprises a tubular piece 35 slipped on the upper end portion of the turbine shaft 17 and secured thereto by suitable means. The nozzle head also includes a ring 37, hexagonal in cross section, which is slipped onto the tubular piece 35 down to a shoulder 36 thereof. The tubular piece 35 is received in a coaxial bore 38 of the ring 37, the midportion of the bore being enlarged as indicated at 39. In order to hold the ring 37 against the shoulder 36, a nut 40 is screwed onto the upper closed end of the tube 35.

In the ring 37, a plurality (e.g., three) of relatively wide bores 41 lead to the outside and are arranged in such a way that they have no component or only a slight component in the circumferential direction. The flow connection between the bore 34 and the fluid outlets 41 occurs through the interior space of the tube 35 as well as through transverse bores 42 in the tube.

In operation of the rotating nozzle 1, fluid to be sprayed is supplied under pressure into the fluid inlet 11. From there, the fluid flows through the gap 32 adjacent the lower surface of the insert body 28 to the three obliquely running bores 34 which generate three fluid jets. These fluid jets have an axial component in the direction of the turbine 13 and also a component in the circumferential direction since the bores which form the passages 31 are inclined at the angle mentioned of 55 degrees with respect to the axis of rotation. As a result, the fluid flowing out of the passages 31 acts circumferentially against the appropriate walls of the grooves 14, whereby the turbine 13 is set in rotation. The fluid flowing through the grooves 14 passes into the zone of the chamber 4 between the turbine 13 and the axial bearing 23. According to pressure relations, a very small part of the fluid passes into the gap of the axial bearing 23 and brings about a fluid lubrication there. By far the greater part of the fluid flows, however, through the radial bores 33 into the bore 34 and from there into the tube 35. The fluid then flows through the transverse bores 42 toward the nozzle outlets 41. Since the turbine shaft 17 is integral with the turbine 13 and since the nozzle head 22 is held against turning on the shaft, it revolves with the turbine 13.

The rotational speed at which the turbine 13 rotates depends on the particular angle the grooves 14 make with respect to the axis of rotation of the turbine shaft 17 and also on the particular angle the passage bores 31 likewise make with respect to the axis of rotation. Further, the rotational speed is influenced by the distance which the lower side 16 of the turbine is spaced from the opposing flat side of the insert body 28. The greater the gap, the lower the rotational speed. A favorable dimension for the gap width is about 1.6 mm, while the outside diameter of the plate forming the turbine 13 is about 32 mm and its thickness is about 8 mm. The cross-sectional area of each outlet bore 41 is approximately 3 $mm^2$ and presents the essential flow-limiting resistance. All the other flow resistances are less in total than the flow resistance evoked by the outlets 41.

Figure 3:
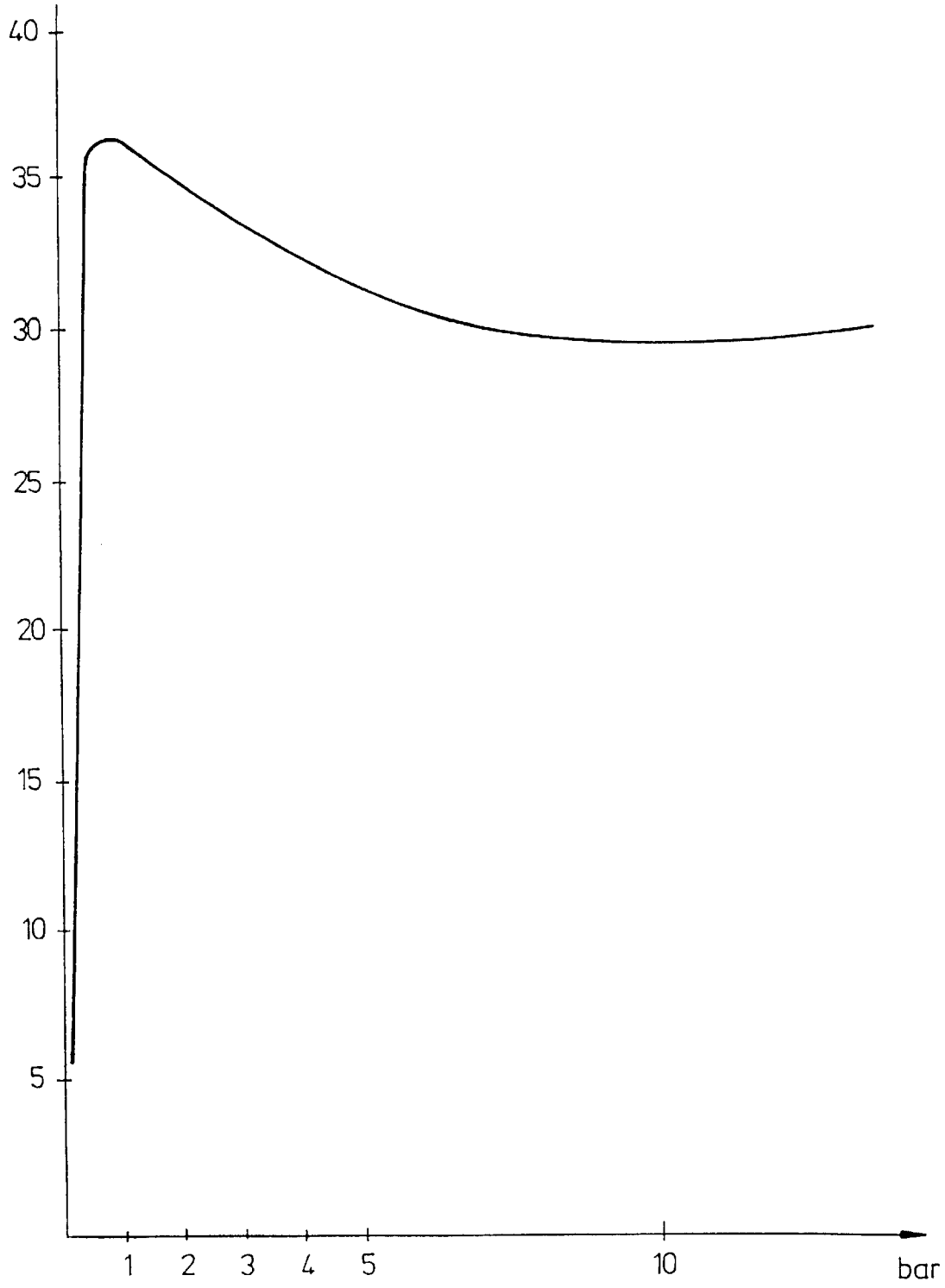
FIG. 3 is a graph illustrating the relationship between rotational speed and operating pressure.

In a nozzle 1 dimensioned in this manner, there is obtained the rotational speed characteristic curve shown in FIG. 3 when the nozzle is supplied with water at room temperature. As is shown, as the pressure rises to about 0.5 bar, the rotational speed of the nozzle head 22 rises proportionally to the pressure to a value of about 37 r.p.m. In the pressure range of between about 0.5 bar and 1.0 bar, the speed curve reverses, and further increases in pressure first lead to a reduction of the rotational speed. For example, when the pressure reaches about 10 bar, the speed of the nozzle head 22 decreases to about 30 r.p.m. Only with a further increase in pressure does the speed again increase. Accordingly, as is evident, the nozzle 1 is a slowly running nozzle and, in the optimum range of its operating pressure, namely between 0.5 bar and 15 bar, no pressure-proportional changes in rotational speed occur. Upwardly from a pressure of 15 bar, the speed increases only insignificantly until the pressure reaches 20 bar. In practical application of such a nozzle, namely, the cleaning of containers, the speed is approximately constant since, for a pressure variation of 1:10, there is in contrast a speed variation of only 1:1.2. It is possible, therefore, without appreciably changing the rotational speed of the nozzle, to rinse the container walls with jets of significantly different pressure.

We claim:

1. A rotating nozzle for spraying jets of fluid, said nozzle comprising a housing having an interior chamber with a fluid inlet and a bearing bore which defines a cylindrical radial bearing surface and an outwardly extending substantially flat axial bearing surface in said chamber, a shaft rotatably supported by said radial bearing surface and extending into said chamber from outside of said housing, said shaft having a radially projecting shoulder defining a substantially flat axial bearing surface located in said chamber adjacent an end of the axial bearing surface defined by said bearing bore for cooperation with the axial bearing surface defined by said bearing bore to form a friction brake in response to the introduction of pressurized fluid into said inlet and chamber, a nozzle head rotatable with said shaft outside of said chamber and having angularly spaced fluid outlets, said shaft defining a passage for establishing fluid communication between said fluid inlet and said fluid outlets, a turbine located in said chamber and coupled directly to said shaft in coaxial relation therewith, a fluid supply for directing pressurized fluid from said inlet, through said chamber and toward said outlets for acting on said turbine to rotate said shaft and nozzle head while simultaneously directing liquid through said passage and outlets, said turbine having surface areas exposed to pressurized fluid in said chamber on upstream and on downstream sides thereof, said turbine surface area on said upstream side being exposed to greater pressure induced forces than said surface area on the downstream side resulting from fluid pressure within said chamber for urging said shaft and the axial bearing surface thereof toward the axial bearing surface defined by said bearing bore, said housing bearing bore being operable for supporting said shaft and nozzle head for rotation at a speed which increases substantially proportional to increases in pressure at said fluid inlet until said pressure reaches a first predetermined value, and said friction brake formed by said axial bearing surfaces cooperating to brake rotational movement of said shaft and nozzle as a result of said axial bearing surfaces being moved toward each other to increase frictional resistance therebetween in response to pressure in said chamber above said first predetermined value acting to force said shoulder axial bearing surface in an axial direction toward said axial bearing surface defined by said bearing bore for limiting rotation of said shaft to a substantially constant speed not exceeding about 35 rpm notwithstanding a substantial increase in pressure from said first predetermined value to a second predetermined value.

2. A rotating nozzle as defined in claim 1 in which said housing radial and axial bearing surfaces are defined by a bushing fixedly secured in said housing.

3. A rotating nozzle as defined in claim 2 in which the axial bearing surface of said bushing is made of PTFE.

4. A rotating nozzle as defined in claim 2 in which a thrust washer is sandwiched between an end of said bushing and the axial bearing surface of said shaft.

5. A rotating nozzle as defined in claim 2 in which the axial bearing surface of said bushing is defined by a separate thrust washer disposed adjacent and end of the bushing.

6. A rotating nozzle as defined in claim 4 in which said washer is made of PTFE.

7. A rotating nozzle as defined in claim 5 in which said axial bearing surface of said bushing and said washer are both made of PTFE.

8. A rotating nozzle as defined in claim 1 further including an injector positioned between said fluid inlet and said turbine and having at least one bore establishing a fluid jet directed toward said turbine and having a circumferential component.

9. A rotating nozzle as defined in claim 8 in which said passage bore in said injector is radially offset with respect to the axis of rotation of said shaft and is obliquely inclined relative to said axis.

10. A rotating nozzle as defined in claim 9 in which said injector includes at least three identically inclined passage bores spaced equally around said axis.

11. A rotating nozzle as defined in claim 10 in which said turbine includes a plurality of angularly spaced passages.

12. A rotating nozzle as defined in claim 11 in which said turbine is defined by a generally cylindrical plate, said passages being formed in an edge portion of said plate and being equally spaced, said passages being obliquely inclined with respect to said axis.

13. A rotating nozzle as defined in claim 12 in which said passages are grooves which open radially and axially out of the edge portion of said plate.

14. A rotating nozzle as defined in claim 12 in which the angle of inclination of said passages of said turbine is less than the angle of inclination of said passage bores of said injector.

15. A rotating nozzle as defined in claim 14 in which the angle of inclination of said passages is within the range of between 10 degrees and 40 degrees, the angle of inclination of said passage bores being in the range of between 15 degrees and 75 degrees.

16. A rotating nozzle as defined in claim 8 further including a stub shaft extending from said turbine in a direction opposite from said shaft and journaled in said injector.

17. A rotating nozzle as defined in claim 8 in which opposing sides of said turbine and said injector are substantially flat.

18. A rotating nozzle for spraying jets of fluid, said nozzle comprising a housing having an interior chamber with a fluid inlet, a bearing bore formed through said housing and opening into said chamber, a bushing having first cylindrical bearing surface located in said bore and a substantially flat axial bearing surface located in said chamber, a shaft rotatably supported by said cylindrical bearing surface and including a substantially flat axial bearing surface located in said chamber in adjacent relation to the axial bearing surface of said bushing for co-acting with said bushing axial bearing surface to form a friction brake, a nozzle head rotatable with said shaft outside of said chamber having spaced fluid outlets, at least one opening within said shaft disposed to permit communication between said chamber and said fluid outlets, a turbine located in said chamber coupled to said shaft, a fluid supply for directing pressurized fluid from said inlet through said chamber toward said outlets for acting on said turbine to rotate said shaft and nozzle head while simultaneously directing liquid through said passage and outlets, said bushing being operable for supporting said shaft and nozzle head for rotation at a speed which increases substantially proportional to increases in pressure at said fluid inlet until said pressure reaches a first predetermined value, said turbine having surface areas exposed to pressurized fluid in said chamber on upstream and on downstream sides thereof, said turbine surface area on said upstream side being exposed to greater pressure induced forces than said surface area on the downstream side resulting from fluid pressure within said chamber for urging said shaft and the axial bearing surface thereof in a direction toward the axial bearing of said bushing, and said friction brake formed by said bushing and shaft axial bearing surfaces being operable to brake rotational movement of said shaft and nozzle as a result of said shaft and bushing axial bearing surfaces being moved toward each other to increase frictional resistance therebetween in response to pressure in said chamber above said first predetermined value acting to force said shaft axial bearing surface in an axial direction toward said bushing axial bearing surface for limiting rotation of said shaft to a substantially constant speed not exceeding about 35 rpm notwithstanding a substantial increase in pressure from said first predetermined value to a second predetermined value.

19. A rotating nozzle as defined in claim 18 in which the dry coefficient of friction between the axial bearing surface of said bushing and the axial bearing surface of said shaft is in a range between 0.05 and 0.15.

20. A rotating nozzle for spraying jets of fluid comprising a housing having an interior chamber with a fluid inlet, said housing having a bearing bore which defines a cylindrical radial bearing surface and an outwardly extending substantially flat axial bearing surface within the chamber, a shaft rotatably supported by the bearing bore having a radially outwardly projecting, substantially flat axial bearing surface which cooperates with the axial bearing surface of the bearing bore to form a thrust bearing, said thrust bearing being responsive to fluid pressure within the chamber to function as a friction brake as a result of said shaft and bearing bore axial bearing surfaces being moved toward each other to increase frictional resistance therebetween in response to pressure in said chamber which acts to force said shoulder axial bearing surface in an axial direction toward said bearing bore axial bearing surface, a nozzle head mounted on said shaft outwardly of said housing and having at least one nozzle outlet opening from which fluid is directed from the nozzle with a radial component with respect to the shaft, said shaft having a fluid transfer passage communicating between said chamber and said nozzle outlet opening, and said shaft having a drive operated without gear transmission by fluid flowing through said inlet, chamber, shaft passage, and nozzle outlet for generating a driving force for the shaft dependent on the pressure of fluid in said chamber.

21. A rotating nozzle as defined in claim 20 in which the dry coefficient of friction between the axial bearing surface of the bearing bore and the axial bearing surface of said shaft is in a range between 0.05 and 0.015.

22. A rotating nozzle for spraying jets of fluid comprising a housing having an interior chamber with a fluid inlet, said housing having a bearing bore which defines a cylindrical radial bearing surface and an outwardly extending substantially flat axial bearing surface within the chamber, a shaft rotatably supported by the bearing bore having a radially outwardly projecting, substantially flat axial bearing surface which cooperates with the axial bearing surface of the bearing bore to form a thrust bearing, a nozzle head mounted on said shaft outwardly of said housing and having at least one nozzle opening from which fluid is directed from the nozzle with a radial component with respect to the shaft, said shaft having a fluid transfer passage communicating between said chamber and said nozzle outlet opening, said shaft being driven by fluid flowing through said inlet, chamber, shaft passage, and nozzle outlet for generating a rotary driving force for said shaft, said shaft having surface areas exposed to pressurized fluid in said chamber on upstream and downstream sides thereof, said shaft surface area on said upstream side being exposed to greater pressure induced forces than said surface area on the downstream side resulting from fluid pressure within said chamber for urging said shaft and the axial bearing surface thereof toward the axial bearing surface defined by said bearing bore, and said thrust bearing being responsive to fluid pressure within the chamber to function as a friction brake as a result of said shaft and bearing bore axial bearing surfaces being moved toward each other to increase frictional resistance therebetween in response to pressure in said chamber which acts to force said shaft and the shoulder axial bearing surface thereof in an axial direction toward said bearing bore axial bearing surface for limiting rotation of said shaft to a substantially constant speed not exceeding about 35 rpm notwithstanding a substantial increase in pressure from a first predetermined value to a second predetermined value.

* * * * *